US009715825B2

(12) United States Patent
Geerlings et al.

(10) Patent No.: US 9,715,825 B2
(45) Date of Patent: Jul. 25, 2017

(54) TRAINABLE TRANSCEIVER WITH HANDS FREE IMAGE BASED OPERATION

(71) Applicant: Gentex Corporation, Zeeland, MI (US)

(72) Inventors: Steven L. Geerlings, Holland, MI (US); Thomas S. Wright, Holland, MI (US); David M. Bostrom, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/140,920

(22) Filed: Apr. 28, 2016

(65) Prior Publication Data

US 2016/0321914 A1 Nov. 3, 2016

Related U.S. Application Data

(60) Provisional application No. 62/154,376, filed on Apr. 29, 2015.

(51) Int. Cl.
*G08C 17/02* (2006.01)

(52) U.S. Cl.
CPC ..... *G08C 17/02* (2013.01); *G08C 2201/20* (2013.01); *G08C 2201/30* (2013.01); *G08C 2201/91* (2013.01)

(58) Field of Classification Search
CPC .... G08C 17/02; G08C 23/04; G08C 2201/30; G08C 17/00; G08C 2201/92; G08C 2201/93; G08C 2201/20; G08C 2201/50
USPC ..... 340/12.54
See application file for complete search history.

(56) References Cited

U.S. PATENT DOCUMENTS

2003/0154656 A1 8/2003 Fitzgibbon et al.
2007/0057810 A1* 3/2007 Bos ..... G08C 17/02 340/12.22
2010/0079267 A1 4/2010 Lin
2011/0250845 A1 10/2011 Chutorash et al.
(Continued)

FOREIGN PATENT DOCUMENTS

WO WO-2013/044077 A1 3/2013

OTHER PUBLICATIONS

International Search Report and Transmittal received in corresponding International Application No. PCT/US2016/029680 mailed Aug. 4, 2016, 8 pages.

*Primary Examiner* — Mark Blouin
(74) *Attorney, Agent, or Firm* — Foley & Lardner LLP; Bradley D. Johnson

(57) ABSTRACT

A method for automatically transmitting an activation signal from a trainable transceiver to a remote electronic system, includes receiving, at a control circuit of the trainable transceiver, image data from an image data source; determining, using the control circuit, if the received image data matches one or more reference images stored in memory and associated with the remote electronic system; and determining, in response to a match between the received image data and the one or more reference images, if the trainable transceiver is approaching the remote electronic system. The method includes, in response to determining that the trainable transceiver is approaching the remote electronic system, formatting an activation signal to control the remote electronic system and transmitting, using a transceiver circuit, the activation signal formatted to control the remote electronic system.

30 Claims, 6 Drawing Sheets

(56) References Cited

U.S. PATENT DOCUMENTS

| | | | | |
|---|---|---|---|---|
| 2013/0141578 | A1 | 6/2013 | Chundrlik et al. | |
| 2015/0302734 | A1* | 10/2015 | Geerlings | G08C 19/28 340/5.25 |
| 2015/0302737 | A1* | 10/2015 | Geerlings | G08C 17/02 340/5.25 |
| 2016/0203721 | A1* | 7/2016 | Wright | H04N 7/18 348/118 |

* cited by examiner

TRAINABLE TRANSCEIVER WITH HANDS FREE IMAGE BASED OPERATION

CROSS-REFERENCE TO RELATED APPLICATIONS

This application claims the benefit of and priority to U.S. Provisional Application No. 62/154,376, titled "Trainable Transceiver with Hands Free Image Based Operation," filed Apr. 29, 2015, which is incorporated herein in its entirety.

TECHNICAL FIELD

The present disclosure relates generally to the field of trainable transceivers for transmitting an activation signal to a remote electronic system.

BACKGROUND

A trainable transceiver generally sends and/or receives wireless signals using a transmitter, receiver, and/or transceiver (e.g., using radio frequency transmission). The wireless signals may be used to control other devices. For example, a trainable transceiver may send a wireless control signal to operate a garage door opener. A trainable transceiver may be trained to operate with a particular device. Training may including providing the trainable transceiver with control information for use in generating a control signal. Training may include enrolling the trainable transceiver with a device. A trainable transceiver may be incorporated in a vehicle (integrally or contained within the vehicle) and used to control devices outside the vehicle. It may be challenging to provide a seamless user experience for automatically transmitting a wireless control signal to a remote electronic device.

SUMMARY

One embodiment relates to a method for automatically transmitting an activation signal from a trainable transceiver to a remote electronic system. The method include receiving, at a control circuit of the trainable transceiver, image data from an image data source. The method includes determining, using the control circuit, if the received image data matches one or more reference images stored in memory and associated with the remote electronic system. The method includes determining, in response to a match between the received image data and the one or more reference images, if the trainable transceiver is approaching the remote electronic system. The method includes, in response to determining that the trainable transceiver is approaching the remote electronic system, formatting an activation signal to control the remote electronic system and transmitting, using a transceiver circuit, the activation signal formatted to control the remote electronic system.

Another embodiment relates to a trainable transceiver for automatically transmitting an activation signal to a remote electronic system. The trainable transceiver includes a transceiver circuit configured to transmit the activation signal to the remote electronic system. The trainable transceiver includes a control circuit including a memory storing reference images. The control circuit is configured to receive image data from an image data source, determine if the received image data matches one or more reference images associated with the remote electronic system, determine if the trainable transceiver is approaching the remote electronic system in response to a match between the received image data and the one or more reference images, and in response to determining that the trainable transceiver is approaching the remote electronic system, format an activation signal to control the remote electronic system and cause the transceiver circuit to transmit the activation signal.

DETAILED DESCRIPTION

Figure 1A:
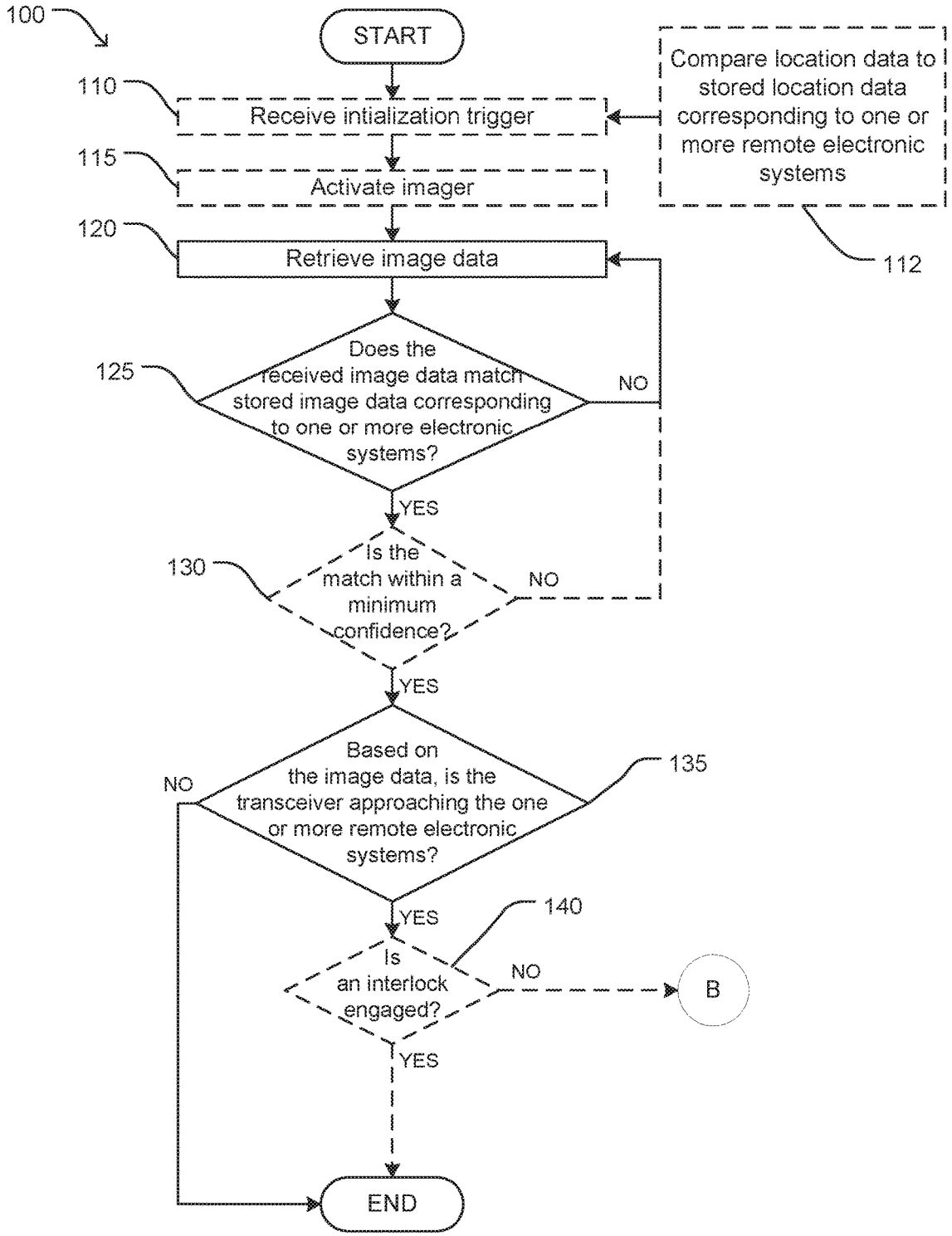
FIGS. 1A-1B illustrates a flowchart for a method of operating a remote electronic system, while approaching the remote electronics system, with a trainable transceiver based on image data available to the trainable transceiver, according to one exemplary embodiment.

According to one exemplary embodiment, a trainable transceiver is configured for wireless control of remote electronic systems by radio frequency (RF) transmissions of activation signals and is configured to automatically control the remote electronic system based on image recognition of features located in geographic proximity to the remote electronic system. Image recognition can be performed using image data of features such as features of buildings such as residences and/or offices, garage doors, driveways, lights or lighting systems, plants, or any other features in proximity to the remote electronic system. The trainable transceiver receives image data and uses image recognition techniques to compare the received image (e.g., recognized or extracted features of the image) to an image or images (e.g., extracted features of an image or images) stored in memory and associated with a remote electronic system. If a match exists, the trainable transceiver transmits an activation signal formatted to control the remote electronic system associated with the stored reference image or images to which the received image(s) were matched. Advantageously, this allows for hands free and automatic operation of trainable transceiver. Furthermore, an advantage is provided in using image recognition based automatic control in that infrared markers or other identifying features (e.g., quick reference codes, bar codes, or other identifying images) are not used. This allows for automatic operation without modifying a remote electronic system or associated component. For example, a user need not provide an infrared marker on or near a garage door in order to facilitate automatic operation.

As described in detail with reference to FIGS. 1A-1B, automatic image based operation of the trainable transceiver may be used to activate a remote electronic system as the trainable transceiver approaches the remote electronic system. As described in more detail with reference to FIG. 2, automatic image based operation of the trainable transceiver may be used to activate a remote electronic system as the trainable transceiver travels away from the remote electronic system.

The trainable transceiver may be trained to control (e.g., format activation signals to control) a remote electronic system using a variety of techniques such as analyzing an activation signal received from an original transmitter associated with a remote electronic system. The trainable transceiver may further be trained for image based operation by storing a reference image associated with a particular remote electronic system. As described in more detail later herein, these techniques may include prompting a user to record a reference image when training the trainable transceiver to control a remote electronic system, automatically storing images when an activation signal is transmitted manually by a user, add additional reference images as the trainable transceiver automatically transmits activation signals using the image based techniques described herein, and/or otherwise storing reference images associated with a remote electronic system.

Image Based Automatic Operation of the Trainable Transceiver

Figure 1B:
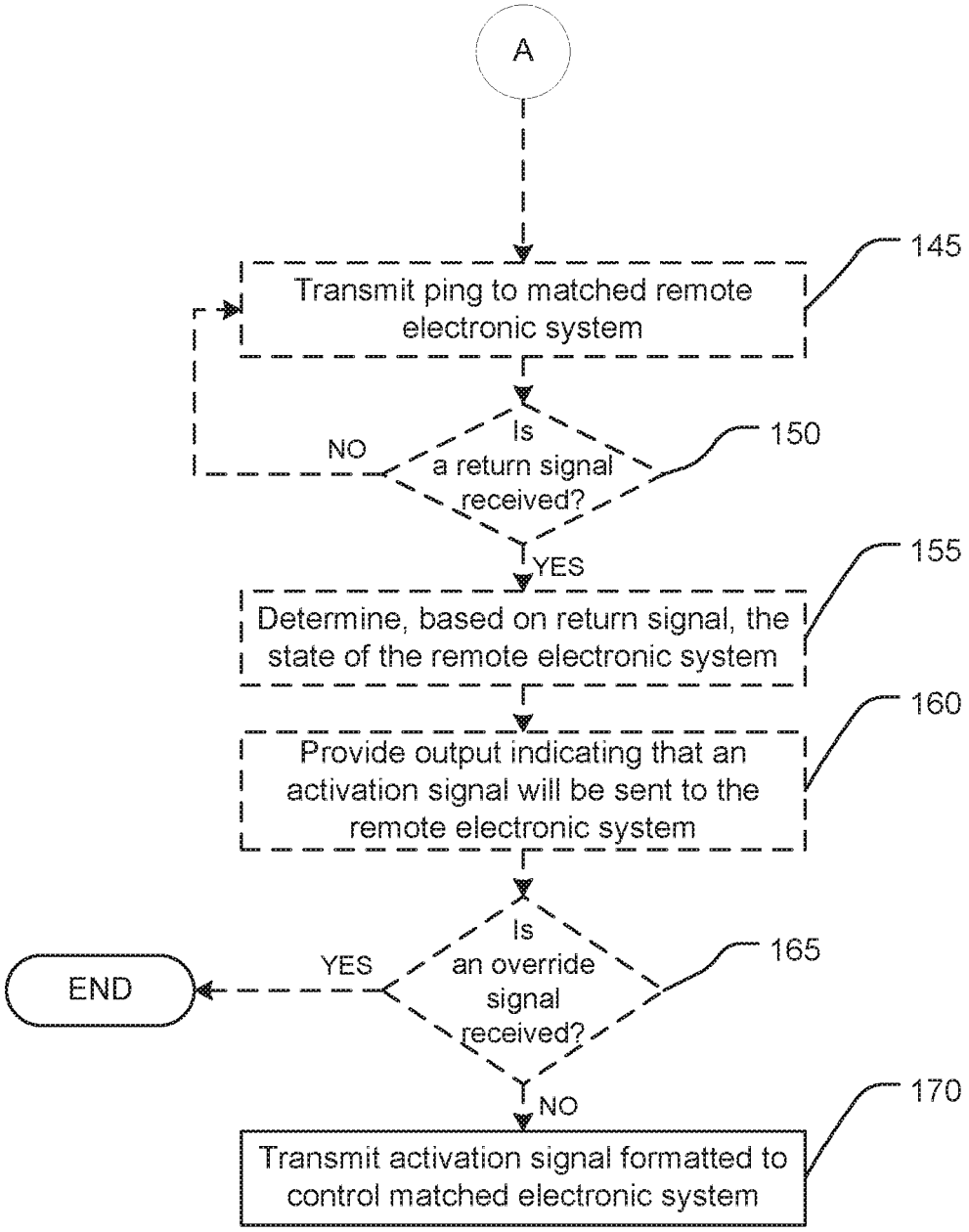

Referring now to FIGS. 1A-1B, a flow chart illustrates a method 100 image based automatic operation of a trainable transceiver according to one embodiment. The flow chart as illustrated depicts steps for automatically transmitting an activation signal as a trainable transceiver approaches a remote electronic system (e.g., opening a garage door as the trainable transceiver approaches). In some embodiments, the same and/or similar steps, functions, or techniques may be used for automatically transmitting an activation signal as the trainable transceiver travels away from the remote electronic system.

In some embodiments, as illustrated by the solid lines in FIGS. 1A-1B, at 120, the trainable transceiver receives image data. The image data may be received at the control circuit from a source of image data. The source of image data may be a camera or camera sensor included in the trainable transceiver. For example, the trainable transceiver may be used as a hand held device, in which case the trainable transceiver includes an integrated camera or camera sensor. The source of image data may be a camera or camera sensor included in a vehicle. For example, the trainable transceiver may be integrated with a vehicle or vehicle component such as a rear view mirror or otherwise be included in a vehicle, in which case a vehicle camera or camera sensor such as a sensor for automatic control of high beam headlights may be used as the source of image data. The image source may be a wired or wireless connection to an image source. For example, the trainable transceiver may include a wireless communication device which is used to receive images from a remote camera or camera sensor, such as an aftermarket backup camera included in a vehicle or other remote camera.

The trainable transceiver processes the received image data using one or more image processing techniques and compares the image data to a reference image or images. The trainable transceiver may use a control circuit and/or an image processing module to process the received image data. The trainable transceiver may use feature extraction techniques and compare extracted features of the received image data to extracted features of the stored reference image(s) associated with one or more remote electronic systems. For example, the trainable transceiver may use application of a Sobel operator to extract image edges and compare those to the extracted edges of the stored reference images(s). For each remote electronic system the trainable transceiver is trained to control, one or more reference images and/or reference extracted image features may be stored which correspond to the remote electronic system.

In some embodiments, the trainable transceiver may process the received image data using templates of expected features. For example, the trainable transceiver may store expected features of homes, garage doors, home lighting systems, etc., and use the expected features to extract features from the received image data and/or categorize or otherwise process reference images.

In some embodiments, reference images and/or reference extracted image features may be stored as part of a training process. Reference images and/or reference extracted image features may be stored over time in response to receiving user inputs corresponding to the remote electronic system. For example, the trainable transceiver may receive a user input for activation of the remote electronic system, and based on the user input, cause an image sensor to capture an image of the remote electronic system and/or associate an image received from the image sensor with the remote electronic system. In this manner, as a user activates the remote electronic system over time, the trainable transceiver learns images or features of images associated with the remote electronic system for later retrieval as reference images.

At 125, the trainable transceiver (e.g., using the control circuit and/or image processing module) determines if the image data matches stored reference image data corresponding to a remote electronic system. If no match is found, the trainable transceiver may receive additional image data (e.g., at 120), and continue to iterate. In some embodiments, the trainable transceiver continuously receives and processes images. For example, while the trainable transceiver is powered on, the trainable transceiver may receive image data and process the received image data iteratively. In some embodiments, the trainable transceiver stops the iterative process if a predetermined time period has elapsed, if a predetermine number of images have been processed with no match, and/or if an end trigger has been activated. For example, the trainable transceiver may stop the iterative process if the trainable transceiver moves a predetermined distance away from locations of trained remote electronic systems.

When it is determined that received image data matches a stored reference image(s), then at 135, the trainable transceiver determines if the trainable transceiver is approaching the remote electronic system corresponding to the stored reference image(s). For example, the trainable transceiver may compare (e.g., using the control circuit and imaging module) received image data to a series of stored reference images with the reference images corresponding to a sequence of approaching the remote electronic system (e.g., images in which a home appears larger in successive images). If the image data matches the reference images for approaching the remote electronic system, the trainable transceiver may determine that the trainable transceiver is approaching the remote electronic system. In alternative embodiments, dead reckoning techniques, the heading of the trainable transceiver, GPS data, and/or other location information corresponding to the trainable transceiver, a vehicle in which the trainable transceiver is located, and/or the remote electronic system may be used to determine if the trainable transceiver is approaching the remote electronic system. If the trainable transceiver is determined not to be approaching the remote electronic system (e.g., stationary or travelling away), the trainable transceiver may end the process. Advantageously, this may prevent unintentional activation of a remote electronic system. For example, this may prevent transmission of an activation signal which would open a garage door when a vehicle is stationary in a driveway or travelling away from the garage door. In some embodiments, the trainable transceiver may continue to iterate the process (e.g., by receiving additional image data). In some embodiments, this step may be omitted.

When it is determined that the trainable transceiver is approaching the remote electronic system or the scene corresponding to the stored reference image, the trainable transceiver formats an activation signal corresponding to a remote electronic system for which the received image data matches the stored reference image of the remote electronic system. For example, activation signal parameters for a remote electronic system may be stored in memory of the trainable transceiver in a data structure (e.g., a table, array, etc.) which associates the activation signal parameters with one or more reference images and/or reference extracted image features. When a match between images is found, the trainable transceiver uses the associated activation signal parameters. In some embodiments, activation signal parameters for a plurality of remote electronic systems may correspond with a single reference image or set of reference images. This may allow the trainable transceiver to control a plurality of remote electronic systems when a match to a location is determined. For example, the stored reference image may be that of a user's home and the stored reference image may have activation signal parameters associated with a garage door opener, home lighting system, home security system, and/or other remote electronic systems. This allows the trainable transceiver to control a plurality of devices at the same location. Alternatively, activation signal parameters for these devices may be stored corresponding to individual stored reference images and corresponding activation signal may be transmitted as the trainable transceiver matches the received image data to the same or substantially the same stored reference images of the remote electronic systems. In some embodiments, upon determining that the trainable transceiver is approaching the one or more remote electronic systems, at 170, the trainable transceiver transmits the activation signal formatted to control the matched remote electronic system.

In some embodiments, the trainable transceiver performs one or more of the additional steps illustrated in FIGS. 1A-1B using dashed lines. In some embodiments, at 110, the trainable transceiver can receive an activation trigger, such as a button press or a determination that the trainable transceiver is within a predetermined distance of remote electronic systems it is trained to control, prior to retrieving a full set of image data and processing the image data (e.g., prior to activating the imager at 115). Advantageously, this prevents the trainable transceiver from processing images continuously. Additionally, this may increase the accuracy of the system.

In some embodiments, the predetermined distance is an absolute distance (e.g., less than or equal to 100 m, 75 m, 50 m, 25 m, 10 m, etc., from the remote electronic system, including any distances between 0 and 100 m). In some embodiments, the predetermined distance is determined based on historical information regarding receipt of activation triggers. For example, the predetermined distance may be associated with one or more distances from the remote electronic system at which activation triggers have previously been received, so as to learn a distance at which an activation trigger is typically received (e.g., received from a user). In some embodiments, the predetermined distance is a sum of a buffer distance and a distance determined based on historical information regarding receipt of activation triggers, such that a duration of time required for processing images occurs prior to a point in time associated with receipt of activation triggers. In other words, the trainable transceiver can provide a seamless user experience by learning expected usage (e.g., expected transmission of activation signals) and tailoring the image processing and transmission of activation signals based on the expected usage.

In some embodiments, at 130, the trainable transceiver determines if matched received image data and stored reference image data matches within a minimum confidence level. If the minimum confidence level is not matched or exceeded, the process does not continue, but rather the trainable transceiver receives additional image data. In some embodiments, the confidence level is predetermined and set during programming or manufacturing of the trainable transceiver.

In some embodiments, at 140, the trainable transceiver determines if an interlock is engaged prior to transmitting an activation signal (e.g., determining if an interlock is engaged in response to determining that the trainable transceiver is approaching one or more remote electronic systems). If an interlock is engaged, an activation signal is not transmitted. The process may end or iterate (e.g., resume with the trainable transceiver receiving additional image data). If no interlock is engaged, the process may continue. For example, an interlock may be a trainable transceiver speed or vehicle speed determined through sensors coupled to the trainable transceiver or integrated with the trainable transceiver or a communications system (e.g., vehicle bus).

In some embodiments, at 145, the trainable transceiver transmits a ping signal to a matched remote electronic system prior to transmitting an activation signal (e.g., based on determining that the transceiver is approaching the one or more remote electronic systems, based on determining that an interlock is not engaged, etc.).

In some embodiments, at 150, the trainable transceiver may determine if a return signal is received. If no return signal is received, the trainable transceiver may be outside of communications range with the remote electronic system. The trainable transceiver may continue to ping the remote electronic system (e.g., as the trainable transceiver moves closer to the remote electronic system) until a return signal is received. Advantageously, this may prevent transmission of the activation signal when the trainable transceiver is outside of control range of the remote electronic system. When a return signal is received, the process continues (e.g., with transmission of the activation signal and/or additional steps).

In some embodiments, the trainable transceiver receives status information from the remote electronic system in response to the transmitted ping. The trainable transceiver may use this information to determine whether to transmit an activation signal (and in some embodiments to transmit a specific command via an activation signal rather than a toggle type activation signal). In some embodiments, at 155, the trainable transceiver determines, based on the return signal, a state of the remote electronic system. The current state of the remote electronic system may be displayed to a user prior to transmission of the activation signal in order to give the user a chance to override the transmission of the activation signal and thereby prevent the remote electronic system from changing state.

In some embodiments, at 160, the trainable transceiver provides an output to a user (e.g., using a user input/output device) indicating that an activation signal will be sent. The output may include additional information such as identifying the remote electronic system(s) for which activation signals will be sent, the current state of the remote electronic system(s), and/or the state of the remote electronic system(s) which would result from transmission of the activation signal. Advantageously, this may allow a user to override an undesired transmission of an activation signal. The output may be text, an image, illumination of a light source (e.g., a multi-colored LED), audio including a verbal description, audio including noises, a vibration, and/or other types of output.

In some embodiments, at 165, the trainable transceiver determines if an override signal has been received. For example, the trainable transceiver may have a window in which a user may provide an override signal (e.g., through a button press, voice command, or other input). If, during the window, an override signal is received, the trainable transceiver may end the process without transmitting an activation signal. If no override signal is received, the trainable transceiver may continue and transmit one or more activation signals. In some embodiments, the override windows is a predetermined amount of time. In some embodiments, the override window begins substantially at the same time that an output indicating that an activation signal will be sent is provided. In some embodiments, the window lasts the duration of the output and for a predetermined amount of time. In some embodiments, the window may be adjustable by a user through a user input/output device of the trainable transceiver.

Figure 2:
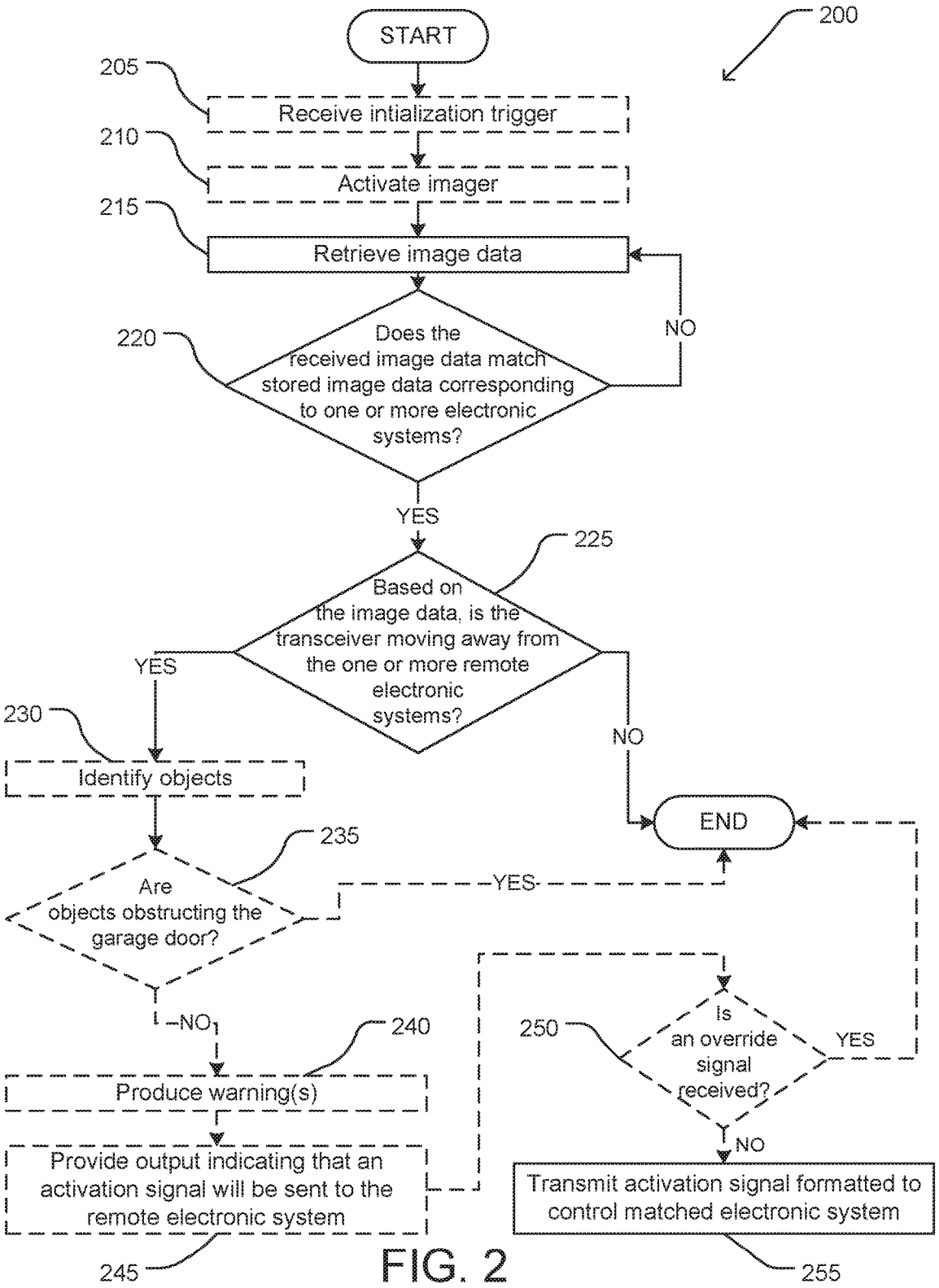
FIG. 2 illustrates a flowchart for a method of operating a remote electronic system, while moving away from the remote electronics system, with a trainable transceiver based on image data available to the trainable transceiver, according to one exemplary embodiment.

Referring now to FIG. 2, a flow chart illustrates a method 200 of image based automatic operation of a trainable transceiver according to one embodiment. The flow chart as illustrated depicts steps for automatically transmitting an activation signal as a trainable transceiver travels away from a remote electronic system (e.g., closing a garage door as the trainable transceiver moves away), but the same and/or similar steps, functions, or techniques may be used for automatically transmitting an activation signal as the trainable transceiver approaches the remote electronic system. Where the steps illustrated in FIG. 2 are the same or similar to those illustrated in FIGS. 1A-1B, the same or techniques, hardware, and/or additional steps as described with reference to FIGS. 1A-1B may be used to carry out the steps illustrated in FIG. 2. For example, at 205, the trainable transceiver can receive an initialization trigger in a manner analogous to step 110 of method 100 or as otherwise described herein; at 210, the trainable transceiver can activate an imager in a manner analogous to step 115 of method 100 or as otherwise described herein. Additionally, steps described with reference to and illustrated in FIGS. 1A-1B but not illustrated in FIG. 2 may none the less be included in the process illustrated by FIG. 2. For example, the trainable transceiver may determine if a match exceeds a minimum confidence level, may determine if an interlock is engaged, may ping a matched remote electronic system, may determine if a return signal is received, may determine a state of the remote electronic system, and/or otherwise perform steps or functions described with reference to FIGS. 1A-1B. In an exemplary embodiment, the steps shown in dotted lines are not included in the process. In other embodiments, varying steps shown in solid lines and dotted lines are used.

At 215, the trainable transceiver receives image data from an imaging system or device. At 220, based on the received image data, the trainable transceiver determines if the received image data matches stored reference images corresponding to one or more remote electronic systems. If a match is found, then at 225, the trainable transceiver determines if the trainable transceiver is moving away from the matched remote electronic system. The trainable transceiver may determine if the trainable transceiver is moving away from the remote electronic system using one or more of a variety of techniques, including techniques similar to those described for determining if the trainable transceiver is approaching a remote electronic system. For example, the trainable transceiver may compare (e.g., using the control circuit and imaging module) received image data to a series of stored reference images with the reference images corresponding to a sequence of images corresponding to travelling away from the remote electronic system (e.g., images in which a garage appears smaller in successive images). If the image data matches the reference images for travelling away from the remote electronic system, the trainable transceiver may determine that the trainable transceiver is travelling away from the remote electronic system.

In alternative embodiments, dead reckoning techniques, the heading of the trainable transceiver, GPS data, and/or other location information corresponding to the trainable transceiver, a vehicle in which the trainable transceiver is located, and/or the remote electronic system may be used to determine if the trainable transceiver is travelling away from the remote electronic system. In response to determining that the trainable transceiver is travelling away from the matched remote electronic system, at 255, the trainable transceiver transmits an activation signal formatted to control the matched remote electronic system.

In some embodiments, the trainable transceiver performs additional steps to prevent unintentional or undesired activation of a remote electronic system. For example, the matched remote electronic system may be a garage door opener. In such a case, it is advantageous to provide additional safety mechanisms.

In some embodiments, at 230, the trainable transceiver uses one or more image recognition techniques to identify objects in an image of the garage associated with the garage door opener. The trainable transceiver may use further image processing techniques to identify a path of the garage door and, at 235, determine if the identified objects are obstructing the garage door. If the identified objects are obstructing the path of the garage door, the trainable transceiver ends the process and does not transmit an activation signal. In some embodiments, the trainable transceiver may provide an output to a user indicating the path is obstructed. If the trainable transceiver determines that the path is not obstructed, the process continues.

In some embodiments, at 240, the trainable transceiver produces warning that the activation signal will be sent and the garage door will close. In some embodiments, the trainable transceiver produces a visual or audible warning using one or more input/output devices included in the trainable transceiver. In some embodiments, the trainable transceiver produces a warning for people in or around the garage. For example, the trainable transceiver may send a control signal to the garage door opener which causes the garage door opener to produce a visual (e.g., flashing light) or audible warning that the garage door is about to close. In some embodiments, the trainable transceiver may be integrated in a vehicle and use communication with the vehicle (e.g., over a communication bus) to cause the vehicle to produce a visual (e.g., flashing headlights) or audible (e.g., honking horn) warning. At 245, the trainable transceiver may further notify a user of the trainable transceiver that the activation signal will be sent by providing an output. The user may provide an override signal which prevents transmission of the activation signal. For example, at 250, the trainable transceiver may determine whether an override signal is received. In response to determining that an override signal is not received, the trainable transceiver can transmit an activation signal formatted to control the matched remote electronic system.

In some embodiments, the trainable transceiver does not operate to control remote electronic systems when travelling away from remote electronic systems. Rather, the trainable transceiver only performs those steps and functions described with reference to FIGS. 1A-1B. In alternative embodiments, the trainable transceiver performs steps illustrated in both FIGS. 1A-1B and FIG. 2 as part of a single operation routine. For example, the trainable transceiver may determine if the trainable transceiver is either approaching or travelling away from a remote electronic system and proceed to carry out the steps and/or functions described in FIGS. 1A-1B or FIG. 2, respectively, depending on the determination.

It should be noted that as described herein, a stored reference image may include a plurality of images. Furthermore, a stored reference image may be or include one or more sets of features extracted from images. As described herein, received image data may include image data corresponding to a single point in time (e.g., a single image) or may include image data corresponding to a segment of time (e.g., multiple images taken over time).

Training of the Trainable Transceiver for Image Recognition

The trainable transceiver may be trained for image based operation by storing a reference image associated with a particular remote electronic system. In one embodiment, the trainable transceiver prompts a user to record a reference image when training the trainable transceiver to control a remote electronic system. For example, the trainable transceiver may provide an output on a user input/output device instructing the user to position the trainable transceiver or vehicle including the trainable transceiver at a location where the user desires the activation signal to be transmitted (e.g., at the entrance to a driveway). In alternative embodiments, these and/or other instructions may be provided in a user manual associated with the trainable transceiver. When the trainable transceiver is trained to control a remote electronic system (e.g., by receiving an activation signal from an original transmitter), the trainable transceiver stores a current image or image data as a reference image associated with the remote electronics system.

In some embodiments, the trainable transceiver automatically stores images as reference images when an activation signal is transmitted manually by a user. The trainable transceiver may include one or more user input/output devices which allow for manual control (e.g., a series of buttons). When an input for transmitting an activation signal is received, the trainable transceiver stores an image as a reference image and associates the reference image with the transmitted activation signal parameters and corresponding remote electronic system. The trainable transceiver may temporarily record a plurality of images and may step back in time from the transmission of the activation signal and store a plurality of prior images as reference images. Advantageously, this may provide a series of reference images which correspond to approaching or travelling away from the remote electronic system. The trainable transceiver may be automatically trained for image recognition based automatic operation blind to the user. For example, as described herein, the trainable transceiver may store reference images based on receiving user input to transmit an activation signal, rather than user input specifically required for storing reference images. In some further embodiments, the trainable transceiver determines when a sufficient number of reference images have been stored to begin automatic operation and when this condition is met prompts the user and/or begins automatic operation.

In some embodiments, the trainable transceiver stores additional reference images when the trainable transceiver automatically transmits activation signals using the image based techniques described herein. When the trainable transceiver operates automatically, the trainable transceiver may store one or more images prior to the transmission of the activation signal as additional reference images corresponding the activation signal parameters and associated remote electronics system. Advantageously, this automatically provides additional reference images without additional user input.

In some embodiments, a user may store supplemental reference images manually. For example, a user may place the trainable transceiver into an image training mode corresponding to a particular remote electronic system using a user input/output device. The user may then use the user input/output device to cause an image to be stored as a reference image for the remote electronic system (e.g., the user may position the vehicle and provide an input to capture image data).

Using one or more of the image training techniques described herein, the trainable transceiver may build a library of reference images over time, in some cases automatically. Advantageously, the addition of reference images may increase the accuracy of the image recognition and image matching techniques. Additional images may also facilitate compensation for changes in the environment such as changes in lighting levels and changes due to weather.

Additional Details Regarding Steps for Image Based Automatic Operation of the Trainable Transceiver Referring again to FIGS. 1A-1B and 2, the initialization trigger received may be based on location data. For example, at 112, location data corresponding to the location of the trainable transceiver (e.g., provided by an internal or vehicle GPS system, dead reckoning system, or heading system, etc.) may be compared to stored location data corresponding to one or more remote electronic systems. When it is determined that the trainable transceiver is within a predetermined distance from one or more remote electronic systems, the trainable transceiver may receive or provide an initialization trigger which begins the process. The trainable transceiver may activate an imager via a command instruction or begin to receive or process image data.

In some alternative embodiments, the trainable transceiver does not include location determining systems and does not receive location data. In other embodiments, the initialization trigger may be one or more of powering on of the trainable transceiver, the elapsing of a predetermined time period since powering on of the trainable transceiver or last activation of the trainable transceiver, receiving vehicle data indicating the vehicle is in a gear other than park, and/or other triggering events.

Referring again to step 130 of determining if the image data matches within a minimum confidence, in some embodiments, the confidence level can be adjusted by a user through the user interface of the trainable transceiver. In other embodiments, the confidence level can be adjusted during installation or by wireless update, can be adjusted by the trainable transceiver (e.g., based on the number of stored reference images corresponding to each remote electronic system, based on a successful operation rate, based on the quality of the image data received, and/or based on other factors), or can otherwise be adjusted.

Referring again to step 140 of determining if an interlock is engaged, in some embodiments the interlock is the speed of the vehicle. If the speed of the trainable transceiver or vehicle is greater than a predetermined value (e.g., 45 miles per hour), the interlock is engaged and prevents transmission of activation signals. Advantageously, this may prevent false positives in matches between received image data and reference image data resulting in a transmitted activation signal. In other embodiments, additional and/or other interlocks may be used such as the location of the trainable transceiver relative to a remote electronic system, the amount of time since an activation signal corresponding to the remote electronic system was last transmitted, and/or other interlocks. In some alternative embodiments, the trainable transceiver may determine if an interlock is engaged before other steps. For example, the trainable transceiver may determine if an interlock is engaged before determining if received image data matches reference image data or before image data is received.

Referring again to step 155 of determining, based on the return signal, the state of the remote electronic system, in some embodiments, the trainable transceiver receives status information from the remote electronic system in response to the transmitted ping. For example, the ping may include a request for status information which may be received as part of the return signal or as an additional signal or communication. Based on the received signal, the trainable transceiver determines the status or current state of the remote electronic system. The trainable transceiver may use this information to determine whether to transmit an activation signal (and in some embodiments to transmit a specific command via an activation signal rather than a toggle type activation signal). For example, the status of the remote electronic system may indicate that a garage door is currently up, while the trainable transceiver approaches the garage door opener. In such a case, the trainable transceiver may determine not to transmit an activation signal as the garage door is already up. The current state of the remote electronic system may be displayed to a user prior to transmission of the activation signal in order to give the user a chance to override the transmission of the activation signal and thereby prevent the remote electronic system from changing state. The status of the remote electronic system may be determined based on the received image data. For example, the trainable transceiver may determine from the received image data that a garage door is up or down using one or more of the image processing techniques described herein to detect the presence or absence of the garage door.

Figure 3:
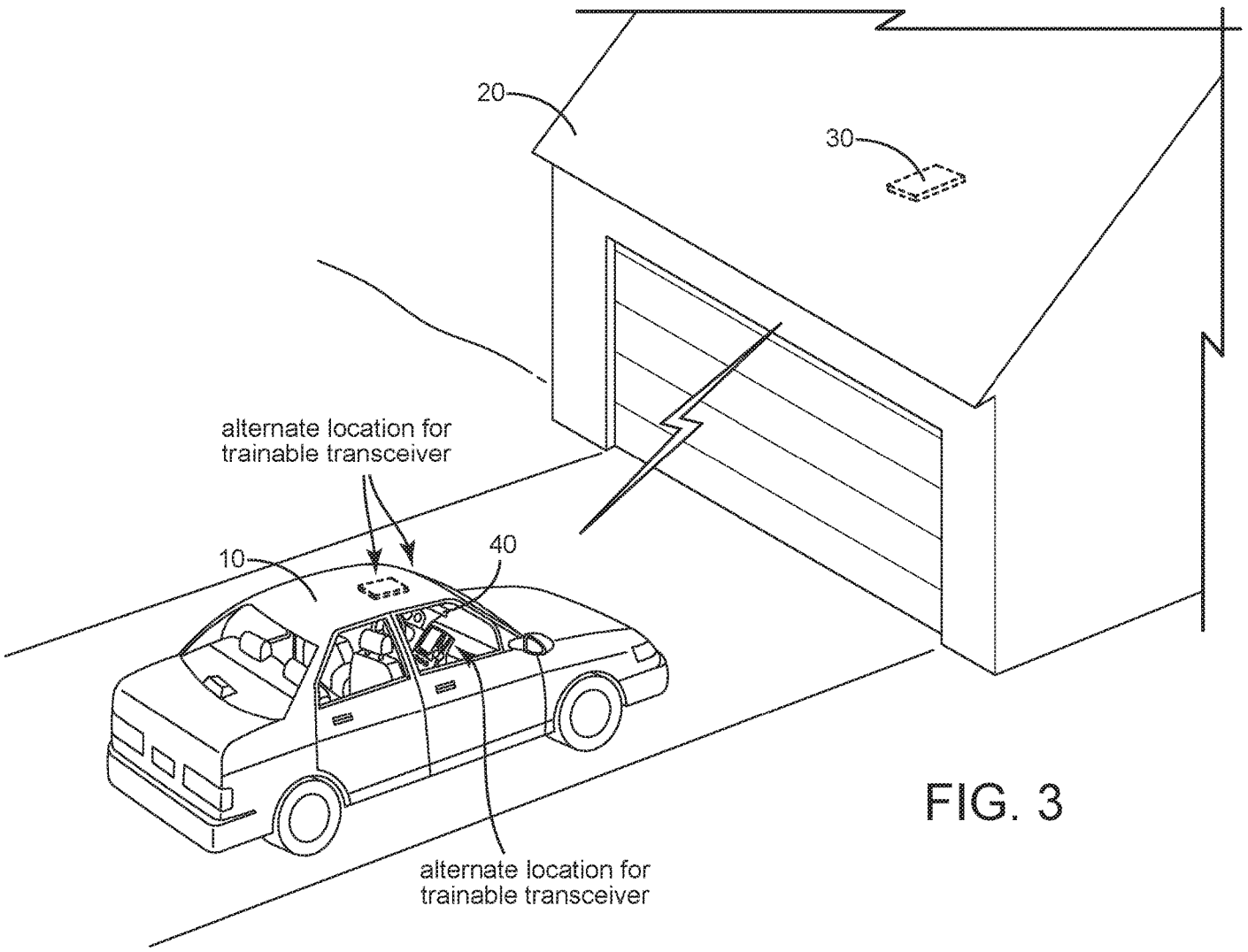
FIG. 3 illustrates a trainable transceiver, for controlling a remote electronic system, located in a vehicle, according to one exemplary embodiment.

Trainable Transceiver Supporting Description of Varying Technical Implementations Referring to FIG. 3, a perspective view of a vehicle 10 and a garage 20 is shown, according to an exemplary embodiment. The garage includes a remote electronic system 30. For example, the garage may include a garage door opener which is controllable by activation signals. A trainable transceiver 40 may be trained to control the garage door opener (e.g., based on an activation signal from an original transmitter associated with the garage door opener, enrolled with the garage door opener such that the garage door opener learns the trainable transceiver, or otherwise trained). The garage 20, a home associated with the garage, an office, and/or other structure may include a garage door opener or other remote electronic system which is controllable by RF activation signals. For example, remote electronic systems may include garage door openers, access barrier systems, lighting control systems, entertainment control systems, electronic door locks, a home security system, a data network (e.g., LAN, WAN, cellular, etc.), a HVAC system, or any other remote electronic system capable of receiving control signals from the trainable transceiver 40 (e.g., other home/office/building automation systems). The trainable transceiver 40 may be trained to operate these or other remote electronic systems.

The trainable transceiver may be included in a vehicle. The vehicle may be an automobile, truck, sport utility vehicle, all-terrain vehicle, snowmobile, boat, personal watercraft, airplane, helicopter, aircraft, or other vehicle. The vehicle 10 is shown to include the trainable transceiver 40. In some embodiments, the trainable transceiver unit is integrated with the vehicle 10. The trainable transceiver 40 may not be removable (e.g., without the use of tools) from the vehicle 10. For example, the trainable transceiver 40 may be integrated with a mirror assembly (e.g., a rear view mirror assembly) of the vehicle 10, integrated with a dashboard of the vehicle 10, integrated with an infotainment system of the vehicle 10, integrated with a headliner of the vehicle 10, or otherwise integrated with the vehicle 10. In other embodiments, the trainable transceiver unit may be removably included with the vehicle 10. For example, the trainable transceiver 40 may be removable clipped to a visor, removably attached to a windshield, or otherwise removably included in the vehicle 10. The trainable transceiver 40 may be operated as described herein irrespective of inclusion in a vehicle. For example, the trainable transceiver 40 may include a camera system and operate remote electronic systems based on image recognition while being handheld.

Specific Components of a Trainable Transceiver and Their Operation

Figure 4:
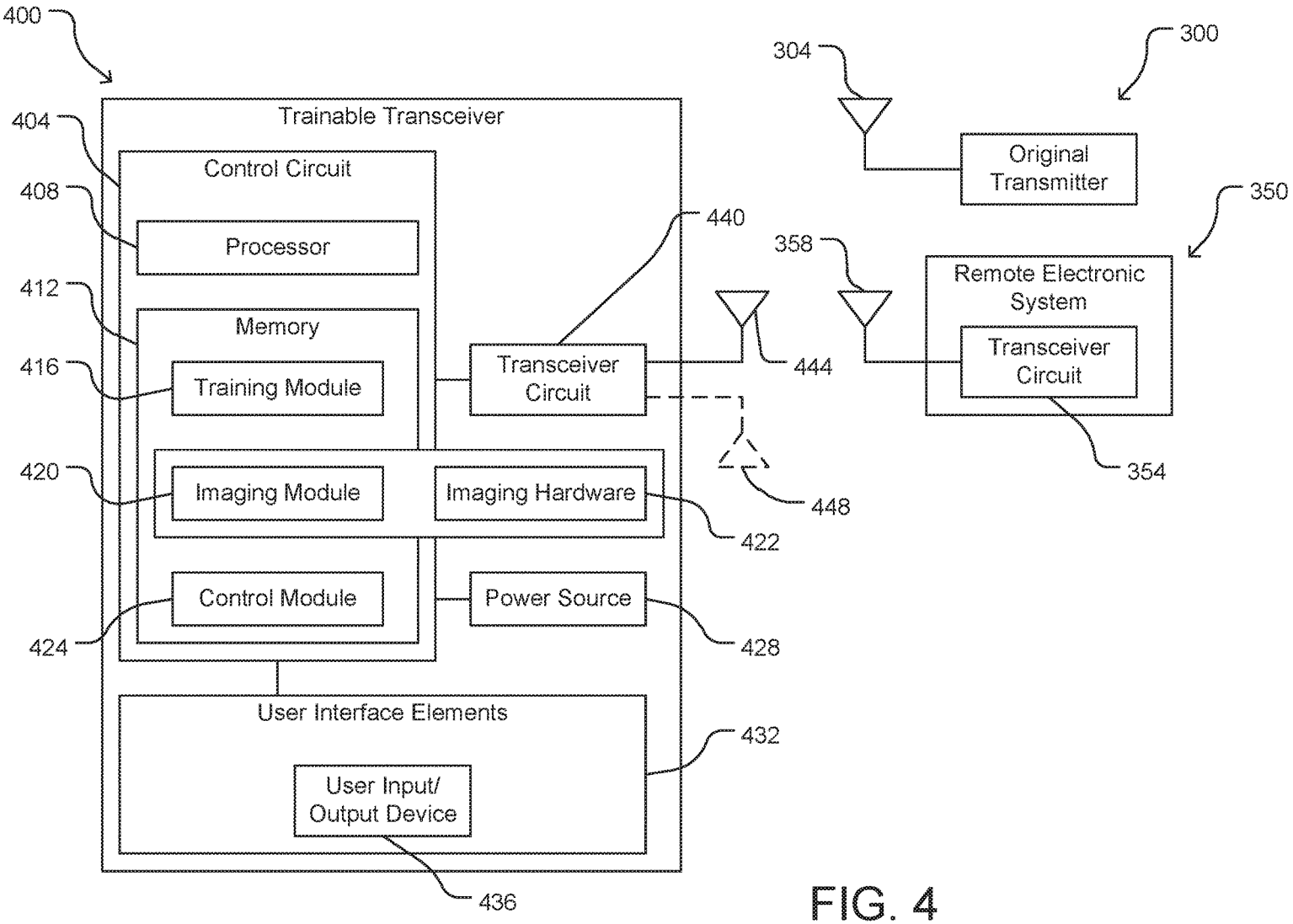
FIG. 4 illustrates a block diagram of the components of a trainable transceiver, according to one exemplary embodiment.

Referring to FIG. 4, a block diagram of a trainable transceiver 400, a remote electronic system 350, and an original transmitter 300 is illustrated according to an exemplary embodiment. The components shown in FIG. 4 can be similar or identical to, and can perform functions as described for, the components illustrated in FIGS. 1A-1B, 2, and 3, and as described herein. In brief overview, trainable transceiver 400 is shown to include user interface elements 432 including a user input/output device 436, a control circuit 404, a power source 428, and a transceiver circuit 440. As controlled by the control circuit 404 (e.g., according to software, programs, functions, instructions, etc. stored in the control module 424 of the memory 412), the trainable transceiver 400 sends activation signals formatted to control the remote electronic system 350 using the transceiver circuit 440. The activation signals are received by the remote electronic system 350 at a transceiver circuit 354 or receiver and cause the remote electronic system 350 to perform an action (e.g., operating a garage door opener motor, responding with a transmitted status signal, etc.). The activation signals may be sent in response to a user input (e.g., a button press received via the user input/output device 436) or may be sent automatically (e.g., based on the image recognition techniques described herein). The trainable transceiver 400 may be trained (e.g., acquire the information for formatting the activation signal for a particular remote electronic system 350) using one or more techniques. For example, the trainable transceiver 400 may receive an activation signal from an original transmitter 300 associated with the remote electronic system 350. The control circuit 404 may process the received signal (e.g., using a program, function, instructions, etc. stored in memory in the training module) and save one or more characteristics of the activation signal in memory 412 for use in formatting activation signals for controlling the remote electronic system 354. In some embodiments, the trainable transceiver 400 is trained to control the remote electronic system 350 by, at least in part, being enrolled with the remote electronic system 350.

User interface elements 432 facilitate communication between a user (e.g., driver, passenger, or other occupant of the vehicle) and the trainable transceiver 400. For example, user interface elements 432 may be used to receive input from a user for causing the trainable transceiver 400 to send an activation signal, train the trainable transceiver 400, or otherwise provide input to the trainable transceiver 400. User interface elements 432 may also provide outputs to the user. For example, user interface elements 432 may provide visual information, audio information, haptic information, or other information related to confirming inputs, indicating the status of a remote electronic system 350, indicating that the trainable transceiver 400 is about to take a certain action, the training of the trainable transceiver 400, signal strength of received signals, and/or other functions or information of the trainable transceiver 400. User interface elements 432 may include user input/output device(s) 436 such as one or more push buttons, switches, dials, knobs, touch-sensitive user input devices (e.g., piezoelectric sensors, capacitive touch sensors, etc.), vibration motors, displays, touchscreens, speakers, microphones, and/or other input or output devices.

Still referring to FIG. 4, the trainable transceiver 400 is shown to include a control circuit 404. The control circuit 404 may be configured to receive input from user input devices 436, imaging hardware 422, transceiver circuit 440, and/or other components of the trainable transceiver 400. The control circuit 404 may be further configured to process the inputs using one or more modules, functions, programs, instructions, and/or other information stored in memory 412. The control circuit 404 may be further configured to provide outputs using the transceiver circuit 440, user input/output devices 436, and/or other components of the trainable transceiver 400. Control circuit 404 is configured to operate or control the components of the trainable transceiver 400 for carrying out the function described herein.

The control circuit 404 may include a processor 408 and memory 412. The processor 408 may be implemented as a general purpose processor, a microprocessor, a microcontroller, an application specific integrated circuit (ASIC), one or more field programmable gate arrays (FPGAs), a CPU, a GPU, a group of processing components, or other suitable electronic processing components. Memory 412 may include one or more devices (e.g., RAM, ROM, Flash® memory, hard disk storage, etc.) for storing data and/or computer code for completing and/or facilitating the various processes, layers, and modules described in the present disclosure. Memory 412 may include volatile memory or non-volatile memory. Memory 412 may include database components, object code components, script components, or any other type of information structure for supporting the various activities and information structures described in the present disclosure. In some implementations, memory 412 is communicably connected to processor 408 via control circuit 404 and includes computer code (e.g., data modules stored in memory) for executing one or more control processes described herein.

Still referring to FIG. 4, the trainable transceiver 400 includes a transceiver circuit 400 and an antenna 444. The transceiver circuit 440 may include transmitting and/or receiving circuitry configured to communicate via antenna 444 with a remote electronic system 350, an original transmitter 300, and/or other device. The transceiver circuit 440 may be configured to transmit wireless control signals having control data for controlling remote electronic system 350 (e.g., activation signals), receive status information from remote electronic systems, receive activation signals from original transmitters, and/or otherwise communicate information with remote devices. The trainable transceiver 400 may transmit and/or receive wireless signals using any suitable wireless standard (e.g., Bluetooth, WiFi, WiMax, etc.) or other communications protocols compatible with or proprietary to remote electronic system. The trainable transceiver 400 may be configured to learn and replicate control signals, activation signals, and/or other signals using any wireless communications protocol. In some embodiments, transmissions from the transceiver circuit 440 may include control data, which can be a fixed code, a rolling code, or another cryptographically-encoded code. The transceiver circuit 440 may transmit and/or receive radio frequency signals in the ultra-high frequency range, typically between 260 and 960 megahertz (MHz), although other frequencies may be used (e.g., 2.4 GHz, the 5 to 5.8 GHz spectrum, etc.).

In some embodiments, the trainable transceiver 400 further includes an imaging module 420. The imaging module 420 is stored in memory 412 and includes programs, instructions, functions, information, algorithms, and/or other software for execution by the processor 408 or control circuit 404 for carrying out the image processing functions described herein. The imaging module 420 is configured to receive images and/or image data and process this information to determine if an image or series of images matches one or more images stored in memory 412 and associated with a remote electronic system 350. If a match is found, this information may be passed to other module (e.g., the control module 424) and an activation signal may be formatted to control the remote electronic system 350 and be transmitted. Advantageously, a user need not provide an input in order to activate a remote electronic system 350 when the trainable transceiver 400 nears the remote electronic system 350 (e.g., such that an image associated with the remote electronic system 350 is captured). The match may be determined based on predefined confidence level.

The imaging module 420 may be further configured to analyze a series of images to determine whether the trainable transceiver 400 is approaching or travelling away from a remote electronic system 350 with corresponding reference images stored in memory 412. For example, by analyzing the shape, size, orientation, and/or other properties of the images and/or changes in these properties across multiple images or frames in comparison to one another and/or the stored reference image(s), the imaging module 420 may determine that the trainable transceiver 400 is approaching the remote electronic system 350. Alternatively, by matching a series of images to a series of stored reference images associated with either approaching or travelling away from the remote electronic system 350, the imaging module 420 may determine if the trainable transceiver 400 is approaching or travelling away from the remote electronic system 350 for which the reference images correspond.

The imaging module 420 may be further configured to analyze an image in order to determine if objects block the path of a garage door, barrier system, or other movable component controlled by a remote electronic system 350. The imaging module 420 uses one or more image processing techniques described herein and/or other techniques to identify the path the garage door or other barrier will travel and processes the image to recognize other objects. The imaging module 420 then determines if these other identified objects are within the path of the garage door or other barrier. For example, the imaging module 420 may identify the location of the objects in relation to the path using an algorithm for estimation of application specific object parameters, such as object pose, object size, object shape, object classification and/or recognition, and/or other parameters. The imaging module 420 may further apply algorithms such as distance determining algorithms to further locate the objects relative to the garage door or other barrier.

A variety of image processing techniques, computer vision techniques, and/or other techniques may be used to process the images and/or image data for the functions described herein. Processing of information from one or more cameras may include digital imaging processing and/or digital signal analysis. This may include classification, feature extraction, pattern recognition, multi-scale signal analysis, reading a machine readable representation, and/or other use of algorithms and/or programs to process information from one or more cameras. For example, the control circuit 404 and/or imaging module 420 in memory 412 may use image processing techniques such as pre-processing using one or more algorithms to prepare images and/or image data for further processing and/or analysis. Pre-processing may include re-sampling an image or image data, applying noise cancellation algorithms to compensate for image sensor noise, applying contrast enhancing algorithms to images and/or image data to enhance detectability of features included in the images, applying scaling algorithms to enhance image structures at appropriate scales or otherwise control the scale of the image, and/or otherwise apply an algorithm or other data handling technique which enhances the images and/or image data for further analysis and/or processing.

The control circuit 404 and/or imaging module 420 in memory 412 may use image processing techniques such as feature extraction using one or more algorithms to identify and/or extract one or more features included in the image and/or image data. Feature extraction may include using one or more algorithms to identify lines, edges, ridges, corners, blobs, points, textures, shapes, motion, and/or other features within the images and/or image data. Tools such as Sobel Filters/Operators, Hough transforms, Harris operators, Principal Curvature-Based Region detectors (PCBR), and/or other algorithms, operators, formulas, and techniques may be used for image feature identification, extraction, or other image processing. Images with containing objects such as garages, houses, buildings, mail boxes, landscaping, gates, driveways, vehicles, and/or other objects may be analyzed using these techniques to build a library of one or more reference images associated with a remote electronic system 350. The reference images or reference library may include reference extracted features such as edges, ridges, corners, blobs, points, textures, shapes, motion, and/or other features. As additional image data is received, current or near current images are processed to identify objects and/or extract features and these features are compared to the library of reference images/features to determine if a match exists. This allows the trainable transceiver 400 to identify that it is close to, approaching, or travelling away from a location associated with a remote electronic system 350 for which the trainable transceiver 400 is trained to control.

The imaging module 420 may receive images and/or image data from one or more sources. In some embodiments, the images and/or image data is received from a remote source in wired or wireless communication with the trainable transceiver 400. For example, the trainable transceiver 400 may include communication hardware such as a Controller Area Network (CAN) bus which allows the trainable transceiver 400 to receive image data from one or more camera sensors included in a vehicle. In some embodiments, the trainable transceiver 400 wirelessly receives image data from a camera sensor located in, on, or around the vehicle. In alternative embodiments, the trainable transceiver 400 includes imaging hardware 422 such as a digital camera, image sensor, light sensor, and/or other hardware for capturing or acquiring images and/or image data. For example, the imager may include one or more of a charge-coupled devices sensor, complementary metal-oxide-semiconductor sensor, photodetector, and/or other imaging hardware. In one embodiment, the trainable transceiver 400 is included in a rear view mirror which includes a camera sensor, and the trainable transceiver 400 receives image data from this sensor. Advantageously, the sensor may be used for multiple functions. For example, the sensor may provide images and/or image data to the trainable transceiver 400 and also provide images and/or image data for use in conjunction with one or more driver aid systems such as lane departure warnings, automatic control of high beam headlights, collision avoidance systems, and/or other drive aid systems.

Figure 5:
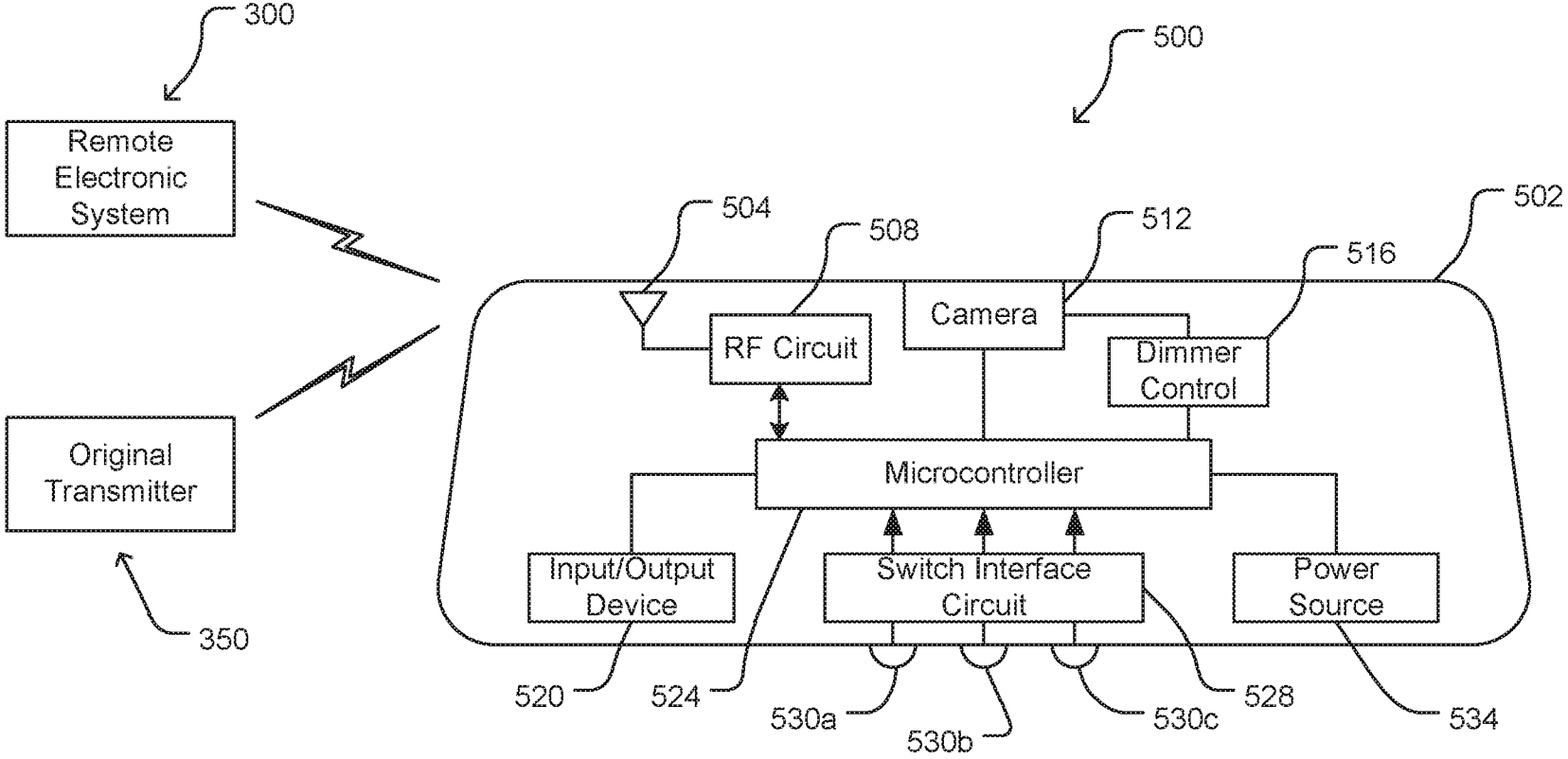
FIG. 5 illustrates a block diagram of the components of a trainable transceiver incorporated into a rear view mirror of a vehicle, according to one exemplary embodiment.

Referring now to FIG. 5, a trainable transceiver is illustrated according to an exemplary embodiment in which the components of the trainable transceiver are integrated in a rear view mirror 500. The rear view mirror 500 and/or a housing 502 attaching the rear view mirror 500 to the headliner, windshield, or other portion of the vehicle includes one or more components of the trainable transceiver. The rear view mirror 500 includes an RF circuit 508 configured to transmit and/or receive activation signals, control signals, and/or other information. The RF circuit 508 may perform the same functions as the transceiver circuit 440 described with reference to FIG. 4. The rear view mirror 500 includes a microcontroller 524 (e.g., control circuit which may include memory having a control module, training module, and/or imaging module) configured to control the operation of the trainable transceiver. The microcontroller 524 accepts input from the switch interface circuit 528, input/output device 520, and/or system on a chip (SoC) camera included in the rear view mirror assembly or other camera or image sensor 512. For example, the microcontroller 524 may receive an input from the switch interface circuit 528 corresponding to a button push by a user (e.g., a button push at one of a user input device 530*a*-530*c*). The microcontroller 524 may cause the RF circuit 508 to transmit an activation signal to a remote electronic system associated with the particular button pressed. The microcontroller 524 may perform the image recognition and image based control functions of the trainable transceiver described herein. In some embodiments, the trainable transceiver does not include buttons or other user input devices, but rather is operated based on the images and/or image data from the SoC camera or other source. In some embodiments, the rear view mirror 500 based trainable transceiver includes an input/output device 520 such as a display embedded in the rear view mirror 500. The microcontroller 524 may cause information regarding the operation of the trainable transceiver to be displayed on the input/output device 520. The microcontroller 524 may receive input from the input/output device 520. The trainable transceiver in the rear view mirror 500 may be powered by a power source 534 such as a battery, connection to a vehicle power system, and/or other power source. The camera 512 of the rear view mirror (e.g., an SoC camera or other type of camera or sensor) may be used in conjunction with one or more driver aids (e.g., carrier out by the microcontroller 524 or other vehicle control components) such as automatically dimming headlights. A dimmer controller 516 may receive inputs from the camera 512 and/microcontroller 524 which cause the dimmer controller 516 to dim headlights of the vehicle, turn off high beam headlights, or otherwise adjust headlight output when oncoming vehicles are detected based on the light level (e.g., from oncoming headlights) measured using the camera 512. Advantageously, the system described herein may use a camera included in a vehicle for use in providing driver aids (e.g., automatically dimming headlights) for performing the image based control of remote electronic systems, thereby allowing for image based control of remote electronic systems without requiring additional camera or image sensors.

What is claimed is:

1. A method for automatically transmitting an activation signal from a trainable transceiver to a remote electronic system, comprising:

receiving, at a control circuit of the trainable transceiver, image data from an image data source;

determining, using the control circuit, if the received image data matches one or more reference images stored in memory and associated with the remote electronic system;

determining, in response to a match between the received image data and the one or more reference images, if the trainable transceiver is approaching the remote electronic system; and in response to determining that the trainable transceiver is approaching the remote electronic system, formatting an activation signal to control the remote electronic system and transmitting, using a transceiver circuit, the activation signal formatted to control the remote electronic system.

2. The method of claim 1, wherein the trainable transceiver is configured to format the activation signal based on one or more activation signal characteristics corresponding to the remote electronic system and stored in memory associated with the one or more reference images associated with the remote electronic system.

3. The method of claim 1, wherein determining if the trainable transceiver is approaching the remote electronic system includes comparing the received image data to a series of reference images stored in memory, associated with the remote electronic system, and corresponding to the trainable transceiver approaching the remote electronic system.

4. The method of claim 1, wherein determining if the trainable transceiver is approaching the remote electronic source includes comparing location data corresponding to the trainable transceiver with location data corresponding to the remote electronic system stored in memory.

5. The method of claim 1, further comprising receiving an initialization trigger at the control circuit of the trainable transceiver, and, in response to response to receiving the initialization trigger, at least one of activating, using the control circuit, the image data source, or transmitting a request for image data to the image data source using a communications interface.

6. The method of claim 5, wherein the initialization trigger is at least one of a determination that the trainable transceiver is within a predetermined distance from the remote electronic system, a determination that a vehicle in which the trainable transceiver is mounted is in a gear other than park, or the trainable transceiver powering on.

7. The method of claim 1, further comprising determining, in response to a match between the received image data and the one or more reference images, that the match exceeds a minimum confidence threshold.

8. The method of claim 1, further comprising determining if an interlock is engaged, wherein if the interlock is engaged, the trainable transceiver does not transmit the activation signal.

9. The method of claim 8, wherein determining if an interlock is engaged includes at least one of determining if a vehicle speed exceeds a threshold value, determining if the trainable transceiver is located beyond a threshold distance relative to the remote electronic system, or determining that an amount of time since an activation signal corresponding to the remote electronic system was last transmitted is less than a threshold time.

10. The method of claim 1, further comprising transmitting, using the transceiver circuit, a ping to the remote electronic system and determining whether a return signal is received, wherein if a return signal is not received, the trainable transceiver does not transmit the activation signal.

11. The method of claim 10, further comprising determining, using the control circuit and based on the return signal, a state of the remote electronic system, and providing an output to a user indicating the state of the remote electronic system using an output device of the trainable transceiver.

12. The method of claim 1, further comprising providing, using an output device of the trainable transceiver, an output to a user indicating that the activation signal will be transmitted to the remote electronic system.

13. The method of claim 1, further comprising determining that the trainable transceiver is travelling away from the remote electronic system and producing a warning prior to transmitting the activation signal.

14. The method of claim 13, further comprising identifying one or more objects in the received image data from the image data source; and determining whether the identified one or more objects are located in a path of a garage door or barrier operated by the remote electronic system; wherein, in response to determining that the identified one or more objects are located in the path of the garage door or barrier operated by the remote electronic system, the trainable transceiver does not transmit the activation signal.

15. The method of claim 1, wherein the image data source is at least one of an image sensor included in the trainable transceiver, an image sensor in communication with the trainable transceiver and located in a vehicle, or a communications bus configured to allow for communication between the trainable transceiver and an image sensor.

16. A trainable transceiver for automatically transmitting an activation signal to a remote electronic system, comprising:

a transceiver circuit configured to transmit the activation signal to the remote electronic system; and a control circuit including a memory storing reference images, the control configured to:

receive image data from an image data source;

determine if the received image data matches one or more reference images associated with the remote electronic system;

determine if the trainable transceiver is approaching the remote electronic system in response to a match between the received image data and the one or more reference images; and in response to determining that the trainable transceiver is approaching the remote electronic system, format an activation signal to control the remote electronic system and cause the transceiver circuit to transmit the activation signal.

17. The trainable transceiver of claim 16, wherein the memory is further configured to store one or more activation signal characteristics corresponding to the remote electronic system and associated with the one or more reference images associated with the remote electronic system, and the control circuit is further configured to format the activation signal based on the one or more activation signal characteristics.

18. The trainable transceiver of claim 16, wherein the control circuit is further configured to determine if the trainable transceiver is approaching the remote electronic system based on comparing the received image data to a series of reference images stored in memory, associated with the remote electronic system, and corresponding to the trainable transceiver approaching the remote electronic system.

19. The trainable transceiver of claim 16, wherein the control circuit is further configured to determine if the trainable transceiver is approaching the remote electronic system based on comparing location data corresponding to the trainable transceiver with location data corresponding to the remote electronic system stored in memory.

20. The trainable transceiver of claim 16, wherein the control circuit is further configured to receive an initialization trigger and, in response to receiving the initialization trigger, perform at least one of activating the image data source or transmitting a request for image data to the image data source using a communications interface.

21. The trainable transceiver of claim 20, wherein the initialization trigger is at least one of a determination that the trainable transceiver is within a predetermined distance from the remote electronic system, a determination that a vehicle in which the trainable transceiver is mounted is in a gear other than park, or the trainable transceiver powering on.

22. The trainable transceiver of claim 16, wherein the control circuit is further configured to determine, in response to a match between the received image data and the one or more reference images, that the match exceeds a minimum confidence threshold.

23. The trainable transceiver of claim 16, wherein the control circuit is further configured to determine if an interlock is engaged, and the control circuit does not cause the transceiver circuit to transmit the activation signal unless the interlock is not engaged.

24. The trainable transceiver of claim 23, wherein the control circuit is further configured to determine if the interlock is engaged based on at least one of determining if a vehicle speed exceeds a threshold value, determining if the trainable transceiver is located beyond a threshold distance relative to the remote electronic system, or determining that an amount of time since an activation signal corresponding to the remote electronic system was last transmitted is less than a threshold time.

25. The trainable transceiver of claim 16, wherein the control circuit is further configured to cause the transceiver circuit to transmit a ping to the remote electronic system and determine whether a return signal is received, and the control circuit does not cause the transceiver circuit to transmit the activation signal unless the return signal is received.

26. The trainable transceiver of claim 25, further comprising an output device, wherein in response to receiving the return signal, the control circuit is further configured to determine a state of the electronic system based on the return signal and cause the output device to provide to a user an output indicating the state of the remote electronic system.

27. The trainable transceiver of claim 16, further comprising an output device, wherein the control circuit is further configured to cause the output device to provide to a user an output indicating that the activation signal will be transmitted to the remote electronic system.

28. The trainable transceiver of claim 16, wherein the control circuit is further configured to determine that the trainable transceiver is travelling away from the remote electronic system and produce a warning prior to transmitting the activation signal.

29. The trainable transceiver of claim 28, wherein the control circuit is further configured to identify one or more objects in the received image data from the image data source, and determine whether the identified one or more objects are located in a path of a garage door or barrier operated by the remote electronic system; and wherein the control circuit does not cause the transceiver circuit to transmit the activation signal in response to determining that the identified one or more objects are location in the path of the garage door or barrier operated by the remote electronic system.

30. The trainable transceiver of claim 16, wherein the image data source is at least one of an image sensor included in the trainable transceiver, an image sensor in communication with the trainable transceiver and located in a vehicle, or a communications bus configured to allow for communication between the trainable transceiver and an image sensor.

* * * * *